US011448019B2

(12) United States Patent
Nield et al.

(10) Patent No.: US 11,448,019 B2
(45) Date of Patent: Sep. 20, 2022

(54) INTERLOCK FOR A DRILL RIG AND METHOD FOR OPERATING A DRILL RIG

(71) Applicants: Barry J. Nield, Jacksonville Beach, FL (US); George A. Nield, Jacksonville Beach, FL (US)

(72) Inventors: Barry J. Nield, Jacksonville Beach, FL (US); George A. Nield, Jacksonville Beach, FL (US)

( * ) Notice: Subject to any disclaimer, the term of this patent is extended or adjusted under 35 U.S.C. 154(b) by 443 days.

(21) Appl. No.: 16/579,269

(22) Filed: Sep. 23, 2019

(65) Prior Publication Data

US 2021/0087895 A1 Mar. 25, 2021

(51) Int. Cl.
*E21B 19/16* (2006.01)

(52) U.S. Cl.
CPC ..... *E21B 19/165* (2013.01); *E21B 19/161* (2013.01)

(58) Field of Classification Search
CPC ..... E21B 19/161; E21B 19/165
See application file for complete search history.

(56) References Cited

U.S. PATENT DOCUMENTS 4,709,766 A * 12/1987 Boyadjieff ..... E21B 19/14 414/22.71
8,517,090 B2 8/2013 Haugen
9,797,208 B2 10/2017 Mosing
9,995,095 B2 6/2018 Thibodeaux
10,138,690 B2 11/2018 Odell, II
10,196,867 B2 2/2019 Mailly
10,253,581 B2 4/2019 Wiedecke
10,287,832 B2 5/2019 Cordes
10,422,188 B2 9/2019 Zheng
2008/0149326 A1* 6/2008 Angelle ..... E21B 19/10 166/77.52
2008/0307930 A1* 12/2008 Veverica ..... E21B 19/164 81/57.15
2009/0217788 A1* 9/2009 Hunter ..... G05D 17/02 166/380
2010/0193198 A1* 8/2010 Murray ..... E21B 19/165 166/380
2012/0055682 A1* 3/2012 Bouligny ..... E21B 41/0021 166/380
2012/0152530 A1* 6/2012 Wiedecke ..... E21B 19/10 166/250.01
2013/0276291 A1* 10/2013 Huseman ..... E21B 19/164 81/57.11
2015/0107850 A1* 4/2015 Mosing ..... E21B 19/164 81/57.16

(Continued)

*Primary Examiner* — Shane Bomar
(74) *Attorney, Agent, or Firm* — Steve LeBlanc, LLC

(57) ABSTRACT

An interlock between a drawworks and a tong includes a sensor for sensing a position of the tong. An interlock signal is generated by the sensor for sensing the position of the tong that is reflective of the position of the tong. A lock operably connected to the drawworks receives the interlock signal and disables operation of the drawworks if the interlock signal meets a predetermined criterion. A method for operating a drill rig includes operating a drawworks to raise and lower a drill string and operating a tong to add or remove segments to the drill string. The method further includes sensing a position of the tong, generating an interlock signal that reflects the position of the tong, and disabling the drawworks if the interlock signal meets a predetermined criterion.

19 Claims, 4 Drawing Sheets

(56) References Cited

U.S. PATENT DOCUMENTS

| | | | | |
|---|---|---|---|---|
| 2018/0073312 | A1* | 3/2018 | Clostio, Jr. | E21B 19/16 |
| 2018/0149010 | A1* | 5/2018 | Zheng | E21B 44/00 |
| 2019/0048688 | A1* | 2/2019 | Nield | G05B 15/02 |
| 2019/0119996 | A1* | 4/2019 | Ly | E21B 47/12 |
| 2020/0063509 | A1* | 2/2020 | Rothe | E21B 19/16 |
| 2020/0149361 | A1* | 5/2020 | Neuville | E21B 19/165 |
| 2020/0157893 | A1* | 5/2020 | Jorud | E21B 19/165 |
| 2020/0284107 | A1* | 9/2020 | Webre | E21B 19/165 |
| 2021/0002995 | A1* | 1/2021 | Botnan | E21B 19/165 |

* cited by examiner

INTERLOCK FOR A DRILL RIG AND METHOD FOR OPERATING A DRILL RIG

FIELD OF THE INVENTION

The present invention generally involves an interlock for a drill rig and a method for operating the drill rig. Particular embodiments of the present invention may be incorporated into land-based or offshore drill rigs used for oil/gas production and/or well service operation to reduce or prevent personnel injury or equipment damage when changing the length of a drill string.

BACKGROUND OF THE INVENTION

Drill rigs are commonly used in oil and gas production and well service operations to bore substantial distances below the earth's surface. A drill rig generally includes a drawworks for raising and lowering a drill string in a borehole. The drawworks generally includes a large drum or spool that holds a cable. The cable extends from the drum to a derrick that supports a block and tackle arrangement holding a traveling block. The traveling block provides a mechanical advantage for raising and lowering the drill string in the borehole. A clutch releasably connects a drive system to the drum to rotate the drum to reel in the cable. To lower the drill string, the clutch may disengage the drive train from the drum, and a brake connected to the drum may be released to allow the weight of the drill string to rotate the drum to release the cable from the drum.

The drill string refers to segments of pipe serially connected to extend into the borehole. The drill string may include hundreds of segments connected by threaded connections at the ends of the segments. Each segment may be approximately thirty feet in length and weigh several hundred pounds. The addition and removal of segments typically involve the coordinated efforts of multiple operators on the drill rig using tools such as tongs (large, self-locking wrenches). When adding a new segment to a drill string, a first tong (a "makeup tong") is used to spin the new segment so that the new segment threads into the end segment of the drill string (i.e., "makeup" a new segment) to make the drill string longer. When removing a segment from a drill string, a second tong (a "breakout tong") is used to spin the end segment to unthread and remove (i.e., "breakout") the end segment from the drill string to make the drill string shorter.

To rotate a segment, a floor worker may move a tong from its storage area and connect the tong to a segment to be added/removed. The tong may be further connected to a mechanical cathead that pulls on the tong to generate the torque required to tighten/loosen the segment to be added/removed. The floor worker may move another tong from its storage area and connect the other tong to the drill string to hold the drill string and keep the drill string from rotating while the segment to be added/removed is rotated. While the tongs are not being used, they are generally stowed out of the way in a storage area on the drill rig floor.

The repetitive nature of adding and removing segments from the drill string, noise associated with the operations, the weight of the segments and equipment manipulating the segments, the magnitude of the forces generated, and various other personnel and environmental factors create an inherently dangerous operating environment. For example, hundreds of segments will be required for a borehole that is 8000 feet deep, requiring floor workers to repeat the above process hundreds of times, some of which will occur late in a work shift and during early morning hours when workers may not be particularly alert and attentive.

A problem arises should the drawworks be activated while a tong is connected to a segment or the drill string which may seriously damage the tong, cathead, and other equipment as well as injure operators. Such may result in interruptions to the drilling operations, expensive repairs, training, personnel injury, and lost revenue. Therefore, the need exists for an improved drill rig system and method for operating the drill rig that incorporates one or more interlocks to protect the tongs while providing a safer and more reliable drill rig operation process.

BRIEF DESCRIPTION OF THE INVENTION

Aspects and advantages of the invention are set forth below in the following description, or may be obvious from the description, or may be learned through practice of the invention.

One embodiment of the present invention is an interlock between a drawworks and a tong that includes a means for sensing a position of the tong. An interlock signal is generated by the means for sensing the position of the tong and is reflective of the position of the tong. A lock operably connected to the drawworks receives the interlock signal and disables operation of the drawworks if the interlock signal meets a predetermined criterion.

An alternate embodiment of the present invention is an interlock for a drill rig that includes a drawworks having a drum operably connected to a drive system and a brake. A cable extends from the drum of the drawworks to a block and tackle arrangement holding a traveling block, and operation of the drawworks causes the drum to release or retract the cable. The interlock further includes a tong and a means for sensing a position of the tong. An interlock signal is generated by the means for sensing the position of the tong and is reflective of the position of the tong. A lock operably connected to the drawworks receives the interlock signal and disables operation of the drawworks if the interlock signal meets a predetermined criterion.

In yet another embodiment of the present invention, a method for operating a drill rig includes operating a drawworks to raise and lower a drill string and operating a tong to add/remove segments to the drill string. The method further includes sensing a position of the tong, generating an interlock signal that reflects the position of the tong, and disabling the drawworks if the interlock signal meets a predetermined criterion.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
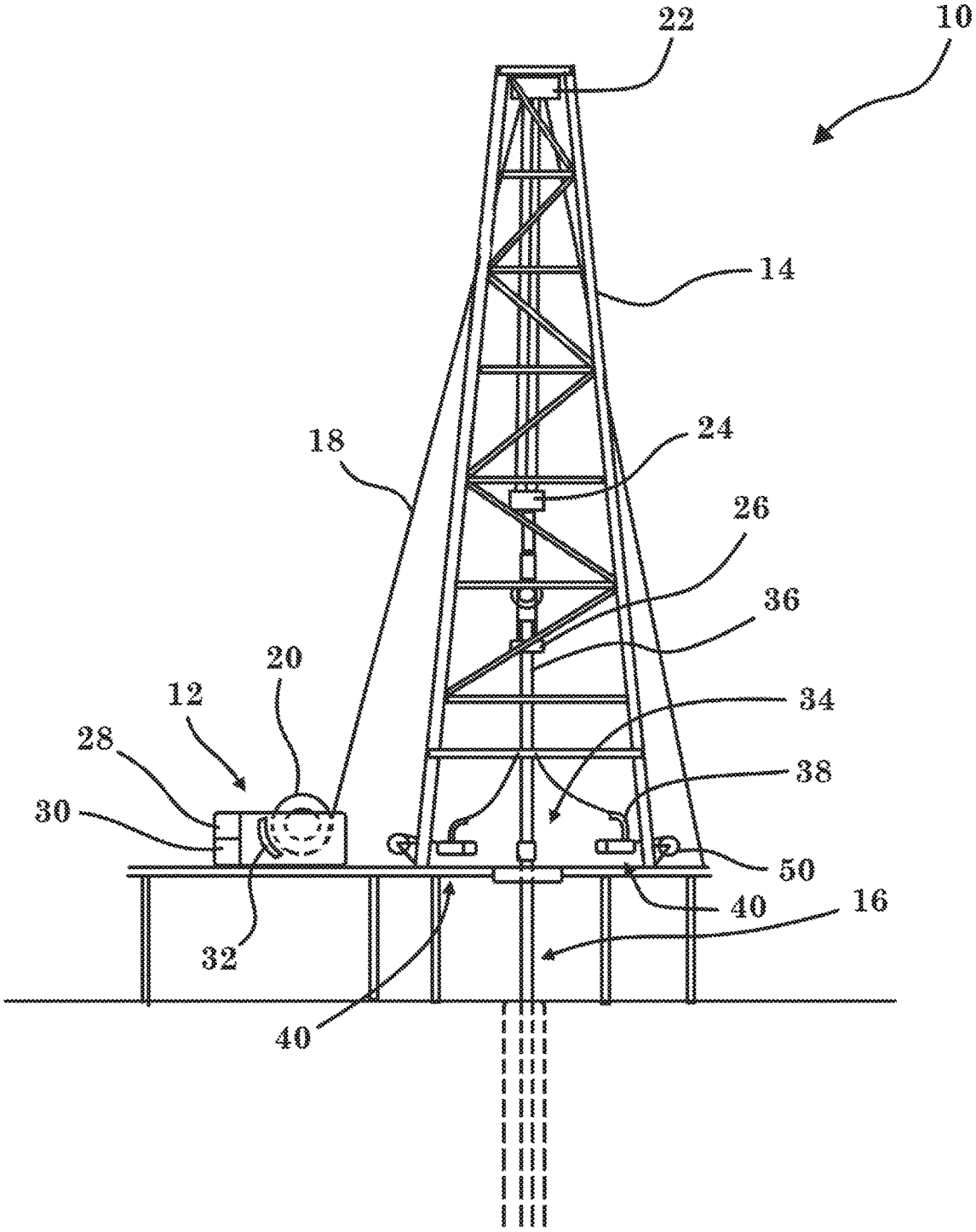
FIG. 1 is a representative drawing of a drill rig according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used in the claims, the definite article "said" identifies required elements that define the scope of embodiments of the claimed invention, whereas the definite article "the" merely identifies environmental elements that provide context for embodiments of the claimed invention that are not intended to be a limitation of any claim.

Embodiments of the present invention include a drill rig and method for operating the drill rig that incorporates one or more interlocks to ensure safe and reliable operation of the drill rig. Referring now to the drawings, FIG. 1 provides a representative drawing of a drill rig 10 according to one embodiment of the present invention. As shown in FIG. 1, the drill rig 10 generally includes a drawworks 12 and associated derrick 14 for raising and lowering a drill string 16. The drawworks 12 generally includes a cable 18 wound around a drum 20. The cable 18 may extend along the derrick 14 to a block and tackle arrangement 22 holding a traveling block 24. An elevator 26 connected to the traveling block 24 may be used to releasably connect the drawworks 12 to the drill string 16. A clutch 28 may releasably connect a drive system 30 to the drum 20 to allow the drive system 30 to rotate the drum 20 to reel in the cable 18. To lower the drill string 16, the clutch 28 may disengage the drive system 30 from the drum 20, and a brake 32 connected to the drum 20 may be released to allow the weight of the drill string 16 and traveling block 24 to rotate the drum 20 to release cable 18. Using this arrangement, as is well-known in the industry, operation of the drawworks 12 causes the drum 20 to release or retract the cable 18 as desired to raise and lower the drill string 16 out of or into the borehole. The borehole generally defines the center of the wellhead area 34 that may provide a staging area for segments 36 to be added or removed from the drill string 16. A pair of tongs 38 used to spin segments 36 (as described below) may be suspended from the derrick 14 and positioned in a storage area 40 away from the borehole when the tongs 38 are not in use.

Figure 2:
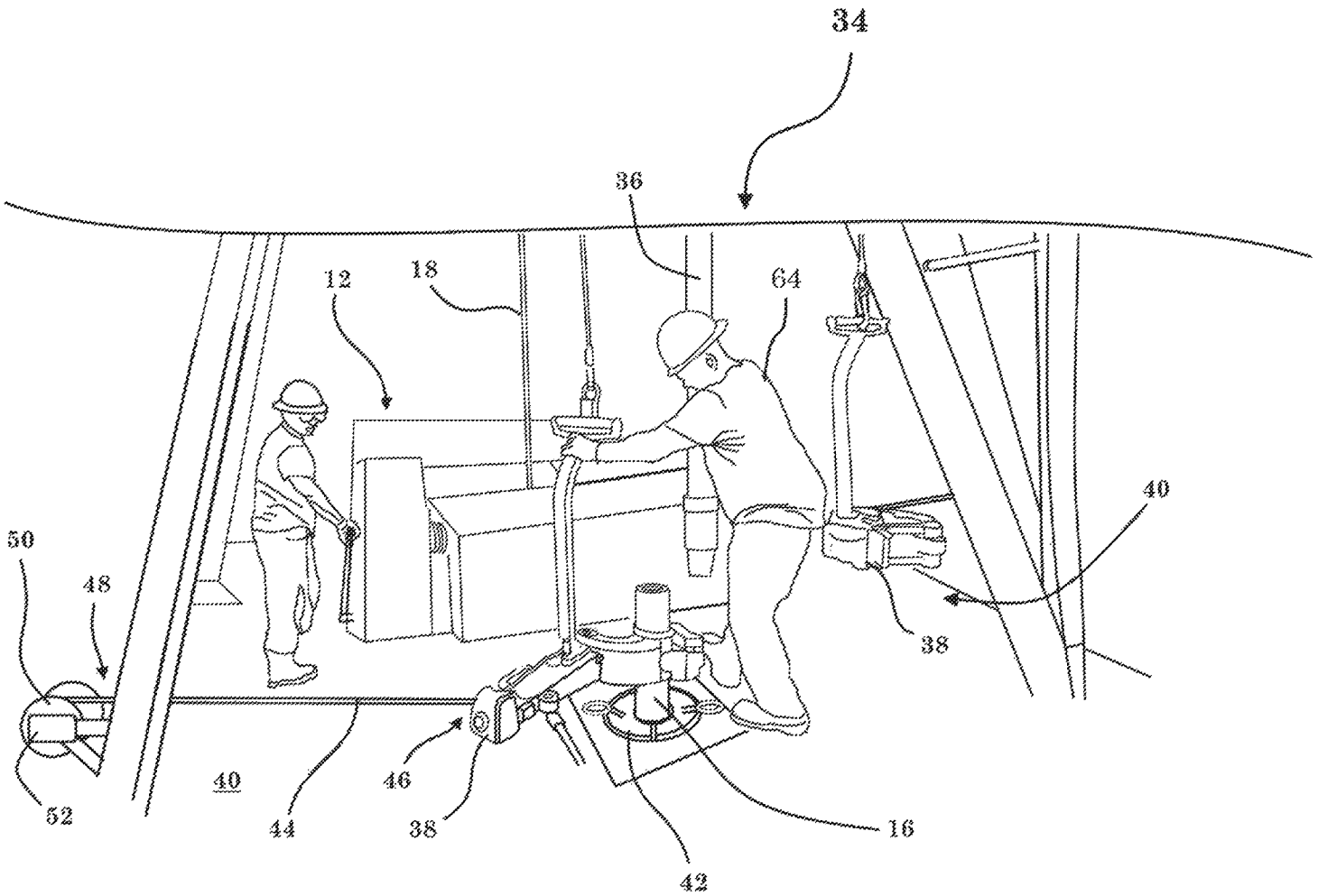
FIG. 2 is an enlarged view of a wellhead area of FIG. 1 providing a staging area for adding and removing drill string segments.

Referring now more particularly to FIG. 2, presented is a closeup view of a wellhead area 34 that provides a staging area for adding and removing drill string segments 36. As shown in FIG. 2, a segment 36 is being added to drill string 16. A slip 42 may be used to hold and support the drill string 16 during such activity. One tong 38 has been removed from its storage area 40 and is engaged with the end of the drill string 16, while another tong 38 remains secured in its storage area 40. For the current embodiment, an extendable tether 44 may connect the tong 38 to a reel 50 that extends or retracts the tether 44, thereby allowing the tong 38 to be maneuvered toward the drill string 16. A motor may rotate the reel 50 to extend or retract the tether 44.

Figure 3:
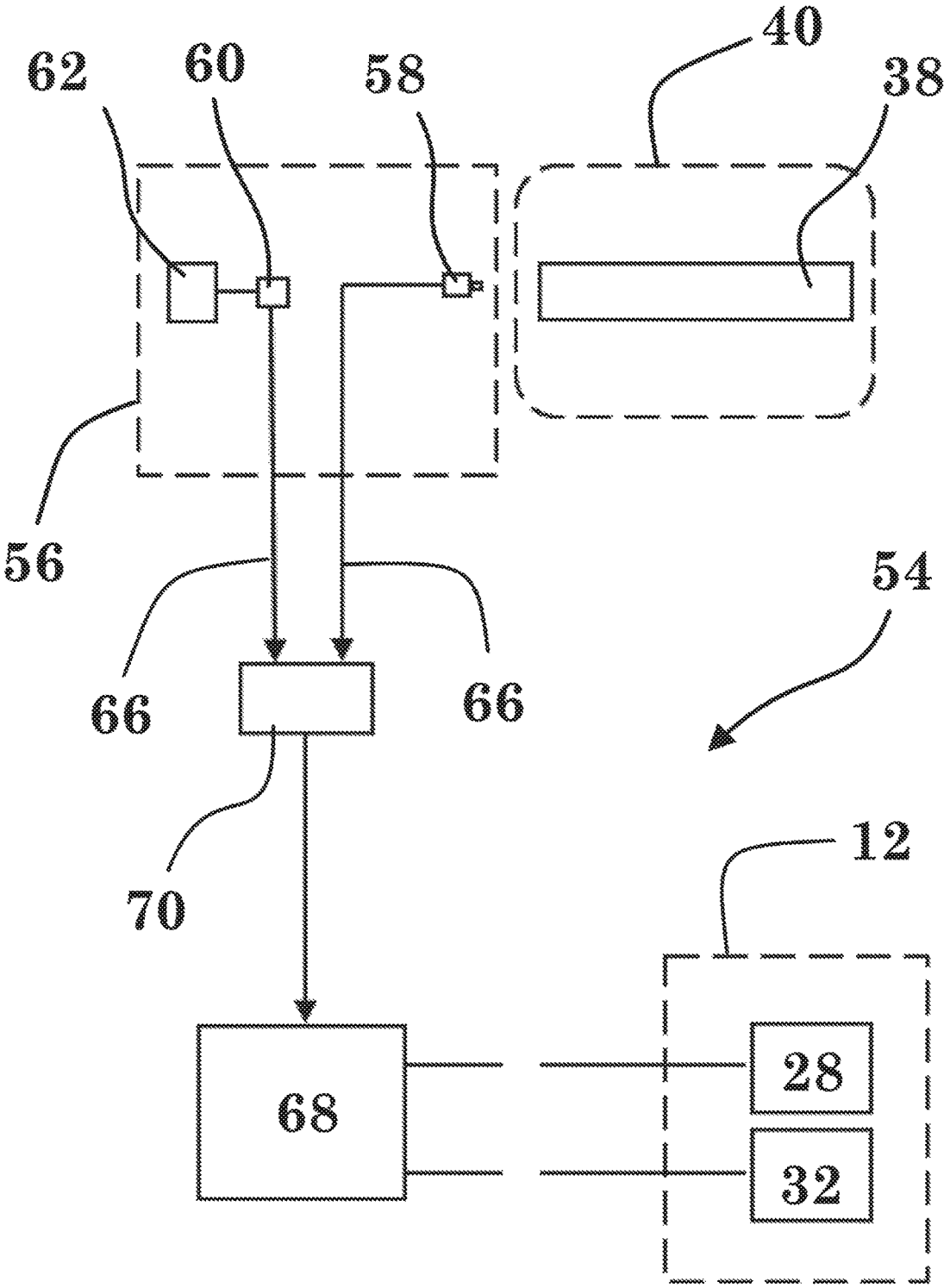
FIG. 3 is a functional block diagram of an interlock according to one embodiment of the present invention.

FIG. 3 provides a functional block diagram of an interlock 54 between the drawworks 12 and the tong 38 according to one embodiment of the present invention. The interlock 54 includes a means 56 for sensing a position of the tong 38. The function of the means 56 is to sense the position of the tong 38, e.g., whether the tong 38 is positioned within its storage area 40, fully retracted, extended, connected to a segment 36, connected to the drill string 16, etc. The structure for performing this function may include one or more sensors that monitor one or more components associated with the tong 38 to determine the position of the tong 38. The particular sensor for performing this function may be a reed switch, a photoelectric sensor, a magnetic field sensor, a proximity sensor, or other sensor known to one of ordinary skill in the art for sensing one or more components associated with the tong 38.

In the particular embodiment shown in FIG. 3, for example, the structure for sensing the position of the tong 38 may be a proximity sensor 58 to detect where the tong 38 is in relation to the storage area 40. For example, the proximity sensor 58 may detect when the tong 38 is in any position other than in the storage area 40, indicating that the tong 38 is being used. Alternatively, the sensor 58 may be positioned to detect when the tong 38 is near to or engaged with the drill string 16 or segment 36.

FIG. 3 illustrates an alternate embodiment of the means 56 for sensing the position of the tong 38 in which the structure for the means is an actuator sensor 60 operably connected to an actuator 62 for operating the tong 38. For this particular embodiment, the actuator sensor 60 may detect a position of the actuator 62, such as a foot pedal or a switch disposed in the wellhead area 34 or operable by a floor worker 64, to determine the position of the tong 38 or whether the tong 38 is in use or in the storage area 40.

In yet another particular embodiment, the means for sensing the position of the tong 38 may be the extendable tether 44 connected to the tong 38 and reel 50 as depicted in FIG. 2. The reel 50 may retract the extendable tether 44 to move the tong 38 back toward the reel 50 or release (extend) the extendable tether 44 to allow the tong 38 to be moved toward the drill string 16. The reel 50 may include a position sensor 52 that measures the length to which the extendable tether 44 has been extended or retracted, thus reflecting the position of the tong 38.

As shown in FIG. 3, the means 56 for sensing the position of the tong 38 generates an interlock signal 66 reflective of the position of the tong 38. For example, the proximity sensor 58 may generate the interlock signal 66 to reflect that the tong 38 is not within its predefined storage area 40. Alternately, for the embodiment shown in FIG. 3 that includes the actuator sensor 60, the actuator sensor 60 may generate the interlock signal 66 to reflect that the actuator 62 has been positioned to allow the tong 38 to be moved outside of storage area 40.

As shown in FIG. 3, the interlock 54 between the drawworks 12 and the tong 38 further includes a lock 68 operably connected to the drawworks 12 to receive the interlock signal 66 and disable operation of the drawworks 12 if the interlock signal 66 meets a predetermined criterion. The lock 66 may be a valve, switch, solenoid, or other device known to one of ordinary skill in the art that produces an output in response to the predetermined criterion. As shown in FIG. 3, the output from the lock 66 may disable operation of the drawworks 12 by actuating the brake 32, releasing the clutch 28, and/or otherwise disabling the drive system 30.

The predetermined criterion may be selected to prevent operation of the drawworks 12 when a tong 38 is in any position that would allow the tong 38 to be connected to the segment 36 or drill string 16. For example, the tong 38 cannot be connected to the segment 36 when the tong 38 is positioned within its storage area 40. As a result, the predetermined criterion may be any interlock signal 66 that indicates the tong 38 is in any position other than in the storage area 40. Referring to the embodiments shown in FIG. 3, for example, the lock 68 may disable operation of the drawworks 12 when the interlock signal 66 generated by the proximity sensor 58 indicates an absence of the tong 38 in proximity to the proximity sensor 58. Alternately, the lock 68 may disable operation of the drawworks 12 when the interlock signal 66 generated by the actuator sensor 60 indicates that the actuator 62 has been positioned to allow the tong 38 to move outside of the storage area 40.

As shown in FIG. 3, the interlock 54 may optionally include a controller 70 operably connected between the means 56 for sensing the position of the tong 38 and the lock 68 to selectively transmit the interlock signal 66 to the lock 68. The controller 70 may be located, for example, in the wellhead area 34 to allow the floor worker 64 to manually interrupt transmission of the interlock signal 66 to the lock 68, or alternately transmitting a desired interlock signal 66 to the lock 68, thereby providing a manual override of the interlock 54.

Figure 4:
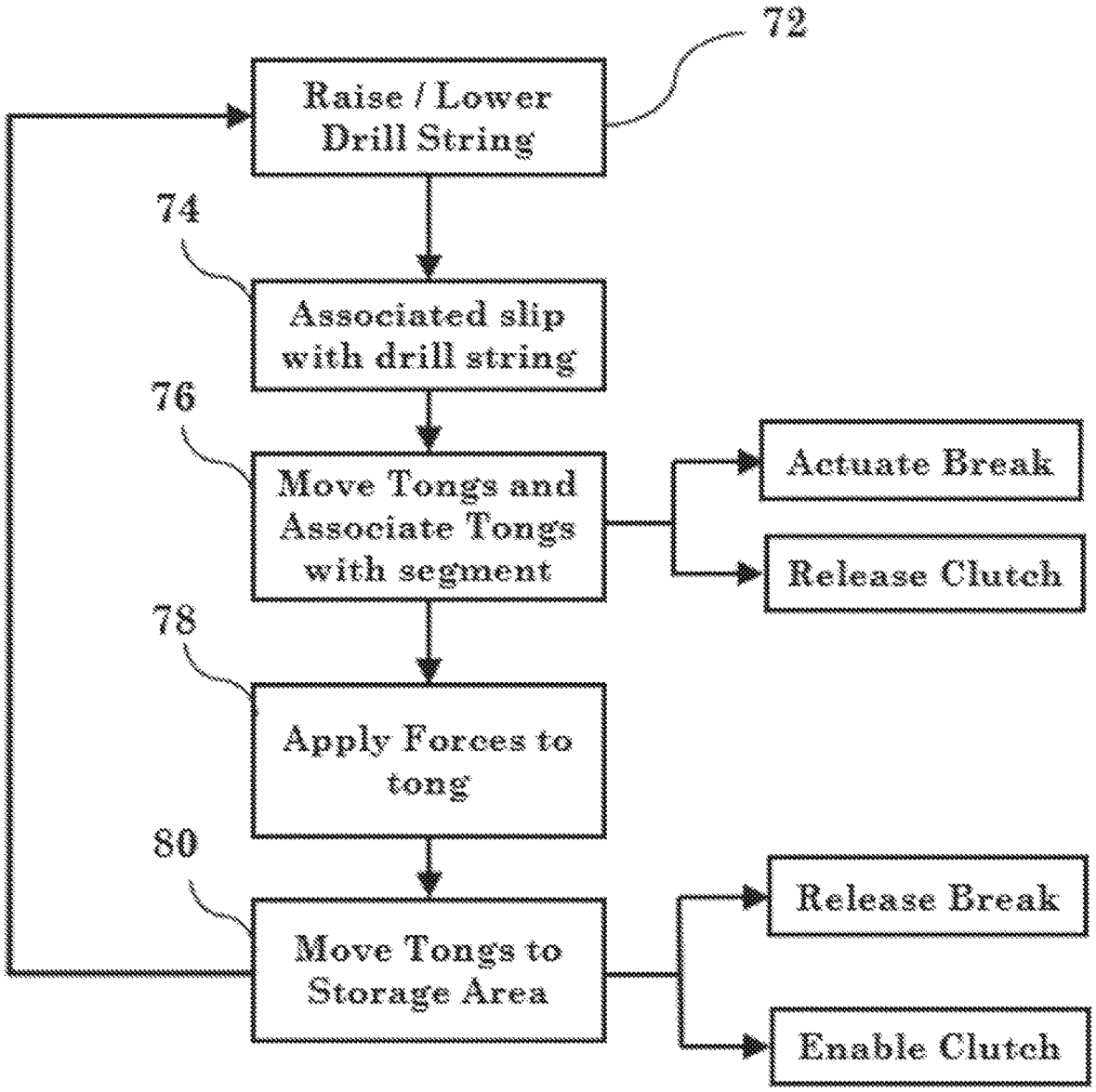
FIG. 4 is a flow diagram of a method for operating the drill rig according to one embodiment of the present invention.

FIG. 4 provides a flow diagram of a method for operating the drill rig 10 according to one embodiment of the present invention. At block 72, the tongs 38 are positioned in their storage area 40, and the interlock signal 66 allows a worker to use the drawworks 12 to raise/lower the drill string 16 (as depicted in FIG. 2). At block 74, the slip 42 is engaged with the drill string 16 to support the drill string 16 while adding/removing the next segment 36. At block 76, one or more tongs 38 are removed from its storage area 40 and associated with the next segment 36 to be added/removed from the drill string 16. As the sensors 58, 60 detect that the tongs 38 are no longer in the storage area 40, the interlock signal 66 changes, and the lock 68 disables operation of the drawworks 12 by actuating the brake 32, releasing the clutch 28, or otherwise disabling the drive system 30.

At block 78, the tongs 38 are operated to add/remove the segment 36 from the drill string 16. At block 80, the tongs 38 may be returned to the storage area 40. As the sensors 58, 60 detect that the tongs are in the storage area 40, the interlock signal 66 changes, and the lock 68 enables operation of the drawworks 12, allowing a floor operator to use the drawworks 12 to raise/lower the drill string 16 as needed. The method then repeats for the next segment 36. The interlock 54 and method for operating the drill rig 10 thus provide enhanced safety and protection for both equipment and personnel by preventing inadvertent operation of the drawworks 12 while any tong 38 is engaged with the segment 36 or drill string 16.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. An interlock between a drawworks and a tong, the interlock comprising:

a means for sensing a position of the tong;

an interlock signal generated by said means for sensing the position of the tong, wherein said interlock signal is reflective of the position of the tong; and a lock operably connected to the drawworks, wherein said lock receives said interlock signal and disables operation of the drawworks if said interlock signal meets a predetermined criterion, wherein said predetermined criterion indicates that the tong has been at least partially extended.

2. The interlock as in claim 1, wherein said means for sensing the position of the tong comprises a sensor that detects a proximity to a drill string.

3. The interlock as in claim 1, wherein said means for sensing the position of the tong comprises an extendable tether connected to the tong and said predetermined criterion indicates that said extendable tether has been at least partially extended.

4. The interlock as in claim 1, wherein said means for sensing the position of the tong comprises a reel connected to the tong by a tether and said predetermined criterion indicates that said reel has at least partially extended said tether.

5. The interlock as in claim 1, wherein said means for sensing the position of the tong comprises a sensor that senses a position of an actuator that controls operation of the tong.

6. The interlock as in claim 1, wherein said lock disables operation of the drawworks by at least one of actuating a brake or releasing a clutch of the drawworks.

7. The interlock as in claim 1, further comprising a controller operably connected between said means for sensing the position of the tong and said lock, and wherein said controller selectively transmits said interlock signal to said lock.

8. An interlock for a drill rig, comprising:

a drawworks comprising a drum operably connected to a drive system and a brake;

a cable that extends from said drum of said drawworks to a block and tackle arrangement holding a traveling block, wherein operation of said drawworks causes said drum to release or retract said cable;

a tong;

a means for sensing a position of said tong;

an interlock signal generated by said means for sensing said position of said tong, wherein said interlock signal is reflective of said position of said tong; and a lock operably connected to said drawworks, wherein said lock receives said interlock signal and disables operation of said drawworks if said interlock signal meets a predetermined criterion, wherein said predetermined criterion indicates that the tong has been at least partially extended.

9. The interlock as in claim 8, wherein said means for sensing the position of said tong comprises a sensor that detects a proximity to a drill string.

10. The interlock as in claim 8, wherein said means for sensing the position of said tong comprises an extendable tether connected to said tong and said predetermined criterion indicates that said extendable tether has been at least partially extended.

11. The interlock as in claim 8, wherein said means for sensing the position of said tong comprises a reel connected to said tong by a tether and said predetermined criterion indicates that said reel has at least partially extended said tether.

12. The interlock as in claim 8, wherein said means for sensing the position of said tong comprises a sensor that senses a position of an actuator that controls operation of said tong.

13. The interlock as in claim 8, wherein said lock disables operation of said drawworks by at least one disabling said drive system or actuating said brake.

14. The interlock as in claim 8, further comprising a controller operably connected between said means for sensing the position of said tong and said lock, and wherein said controller selectively transmits said interlock signal to said lock.

15. A method for operating a drill rig, comprising: operating a drawworks to raise and lower a drill string; operating a tong; sensing a position of the tong; generating an interlock signal that reflects the position of the tong; and disabling the drawworks if said interlock signal meets a predetermined criterion, wherein said predetermined criterion indicates that the tong has been at least partially extended.

16. The method as in claim 15, further comprising sensing a position of the tong with respect to the drill string.

17. The method as in claim 15, further comprising sensing a position of an actuator for the tong and generating said interlock signal based on the position of said actuator.

18. The method as in claim 15, further comprising disabling operation of the drawworks by at least one of disabling a drive system or actuating a brake associated with the drawworks.

19. The method as in claim 17, further selectively transmitting said interlock signal to disable the drawworks.

* * * * *